US008966859B2

(12) United States Patent
Keller et al.

(10) Patent No.: US 8,966,859 B2
(45) Date of Patent: Mar. 3, 2015

(54) STAIRCASE AND METHOD FOR CONSTRUCTION

(71) Applicant: Signature Companies, Haymarket, VA (US)

(72) Inventors: Philip R. Keller, Mercersburg, PA (US); Jeffrey A. Kaminski, Shippensburg, PA (US); Shoukat A. Turabi, Vienna, VA (US)

(73) Assignee: Signature Companies, Haymarket, VA (US)

( * ) Notice: Subject to any disclaimer, the term of this patent is extended or adjusted under 35 U.S.C. 154(b) by 0 days.

(21) Appl. No.: 14/197,355

(22) Filed: Mar. 5, 2014

(65) Prior Publication Data

US 2014/0190118 A1 Jul. 10, 2014

Related U.S. Application Data

(62) Division of application No. 13/438,575, filed on Apr. 3, 2012, now Pat. No. 8,707,638.

(51) Int. Cl.

| | |
|---|---|
| ***E04B 1/00*** | (2006.01) |
| ***E04F 11/025*** | (2006.01) |
| ***E04F 11/02*** | (2006.01) |
| ***E04F 11/035*** | (2006.01) |
| ***E04F 11/108*** | (2006.01) |

(52) U.S. Cl.

CPC ..... *E04F 11/025* (2013.01); *E04F 11/02* (2013.01); *E04F 11/035* (2013.01); *E04F 11/108* (2013.01)

USPC ..... 52/741.2; 52/188; 52/191

(58) Field of Classification Search

USPC ..... 52/741.29, 182, 188, 10, 191, 741.2, 52/179, 184, 190, 177

See application file for complete search history.

(56) References Cited

U.S. PATENT DOCUMENTS

| | | | | | |
|---|---|---|---|---|---|
| 184,013 | A | * | 11/1876 | Krickl | 52/179 |
| 256,336 | A | * | 4/1882 | Lawrence | 52/177 |
| 307,551 | A | * | 11/1884 | Jackson | 52/188 |
| 381,407 | A | * | 4/1888 | Momberg | 52/188 |
| 448,566 | A | * | 3/1891 | Williams | 52/188 |
| 1,475,777 | A | * | 11/1923 | Ballenger | 52/189 |

(Continued)

FOREIGN PATENT DOCUMENTS

| | | |
|---|---|---|
| JP | 11-247290 | 9/1999 |
| JP | 2002-021278 A | 1/2002 |

OTHER PUBLICATIONS

International Searching Authority/Korean Intellectual Property Office (ISA/KR). International Search Report and Written Opinion, PCT Application No. PCT/US2013/035156. Aug. 5, 2013.

*Primary Examiner* — James Ference

(74) *Attorney, Agent, or Firm* — The Marbury Law Group, PLLC

(57) ABSTRACT

A staircase and method for producing the same. The staircase is produced by double routing channels for sub-treads and sub-risers and capping risers and capping treads. These sub-treads and sub-risers are assembled into staircase stringers that have pre-routed channels that are sufficient to install sub-treads and sub-risers having a particular thickness and having room for subsequent placement or installation of capping treads and risers by sliding them laterally into the channels created by the double routing of the stringers. This creates a more finished look to be (the) staircase while avoiding damages to the capping treads and risers that might occur during building construction.

16 Claims, 10 Drawing Sheets

(56) References Cited

U.S. PATENT DOCUMENTS

| | | | | | |
|---|---|---|---|---|---|
| 2,021,457 | A | * | 11/1935 | Mackenzie | 52/191 |
| 2,827,675 | A | * | 3/1958 | Nelson | 52/179 |
| 3,196,997 | A | * | 7/1965 | Hager | 52/182 |
| 3,287,867 | A | * | 11/1966 | Aton | 52/179 |
| 3,370,387 | A | * | 2/1968 | Sivley | 52/188 |
| 3,393,481 | A | * | 7/1968 | Meuret | 52/188 |
| 3,596,941 | A | * | 8/1971 | Tracy | 403/27 |
| 4,154,032 | A | * | 5/1979 | Strub | 52/188 |
| 4,367,613 | A | * | 1/1983 | Strub | 52/188 |
| 4,413,460 | A | * | 11/1983 | Gerlach | 52/741.2 |
| 4,422,270 | A | * | 12/1983 | Lapointe et al. | 52/182 |
| 4,583,335 | A | * | 4/1986 | Morellini | 52/182 |
| 4,783,939 | A | * | 11/1988 | Bergmann et al. | 52/188 |
| 4,819,391 | A | * | 4/1989 | Tassin et al. | 52/182 |
| 4,866,894 | A | * | 9/1989 | Brown | 52/182 |
| 4,875,315 | A | * | 10/1989 | Champagne | 52/189 |
| 5,163,491 | A | * | 11/1992 | Smith | 144/353 |
| 5,205,093 | A | * | 4/1993 | Schuette | 52/182 |
| 5,239,796 | A | | 8/1993 | Maloney | |
| 5,347,774 | A | * | 9/1994 | Smith | 52/182 |
| 5,502,933 | A | * | 4/1996 | Skillern | 52/182 |
| 5,531,048 | A | * | 7/1996 | Darling | 52/188 |
| 5,613,341 | A | * | 3/1997 | Skillern | 52/741.2 |
| 5,636,483 | A | * | 6/1997 | Wille | 52/188 |
| 5,660,009 | A | * | 8/1997 | Cousin | 52/183 |
| 5,720,136 | A | * | 2/1998 | Turner | 52/182 |
| 5,806,253 | A | * | 9/1998 | Nelson | 52/179 |
| 5,806,254 | A | * | 9/1998 | Bennett | 52/182 |
| 5,899,032 | A | * | 5/1999 | Buzby | 52/182 |
| 5,907,935 | A | * | 6/1999 | Elena | 52/182 |
| 6,067,758 | A | * | 5/2000 | Zenkner | 52/182 |
| 6,088,977 | A | * | 7/2000 | Lawrence | 52/182 |
| 6,112,480 | A | * | 9/2000 | Turner | 52/182 |
| 6,115,975 | A | * | 9/2000 | Abdollahi | 52/179 |
| 6,125,598 | A | * | 10/2000 | Lanphier | 52/182 |
| 6,397,529 | B1 | * | 6/2002 | Grenier | 52/182 |
| 6,516,574 | B1 | * | 2/2003 | Couture | 52/182 |
| 6,758,016 | B2 | * | 7/2004 | Gobeil | 52/191 |
| 6,860,460 | B2 | * | 3/2005 | Rellergert | 249/14 |
| 7,162,805 | B2 | * | 1/2007 | Vick | 33/42 |
| 7,464,505 | B2 | * | 12/2008 | Grenier | 52/179 |
| 7,469,516 | B2 | * | 12/2008 | Smith | 52/741.2 |
| 7,757,443 | B2 | | 7/2010 | Ringness | |
| 7,946,085 | B2 | * | 5/2011 | Prins | 52/191 |
| D646,955 | S | * | 10/2011 | Sanders et al. | D8/354 |
| 8,307,603 | B1 | * | 11/2012 | Mitchell et al. | 52/741.2 |
| 2001/0027627 | A1 | * | 10/2001 | Lawrence | 52/182 |
| 2002/0088669 | A1 | * | 7/2002 | Truckner et al. | 182/228.1 |
| 2003/0093959 | A1 | * | 5/2003 | Couture | 52/182 |
| 2003/0208971 | A1 | * | 11/2003 | Couture | 52/182 |
| 2005/0160688 | A1 | * | 7/2005 | Truckner et al. | 52/182 |
| 2006/0150539 | A1 | * | 7/2006 | Vanhastel et al. | 52/179 |
| 2006/0156649 | A1 | * | 7/2006 | Smith | 52/182 |
| 2006/0196129 | A1 | * | 9/2006 | Lin | 52/188 |
| 2006/0230693 | A1 | * | 10/2006 | Giordano | 52/182 |
| 2006/0260224 | A1 | * | 11/2006 | Grenier | 52/182 |
| 2007/0022679 | A1 | * | 2/2007 | Barry et al. | 52/187 |
| 2007/0022697 | A1 | * | 2/2007 | Barry et al. | 52/654.1 |
| 2007/0144084 | A1 | * | 6/2007 | Barry et al. | 52/187 |
| 2008/0216421 | A1 | * | 9/2008 | Chung et al. | 52/179 |
| 2008/0216422 | A1 | * | 9/2008 | Chung et al. | 52/188 |
| 2008/0244997 | A1 | * | 10/2008 | Truckner | 52/182 |
| 2008/0271390 | A1 | * | 11/2008 | Lopez | 52/177 |
| 2009/0056245 | A1 | * | 3/2009 | Miller | 52/188 |
| 2009/0205267 | A1 | * | 8/2009 | Prins | 52/105 |
| 2009/0235594 | A1 | * | 9/2009 | Won | 52/179 |
| 2009/0277104 | A1 | * | 11/2009 | McCool | 52/179 |
| 2009/0277105 | A1 | * | 11/2009 | Truckner | 52/191 |
| 2010/0287854 | A1 | * | 11/2010 | Couture et al. | 52/184 |
| 2010/0319278 | A1 | * | 12/2010 | Grenier | 52/182 |

* cited by examiner

STAIRCASE AND METHOD FOR CONSTRUCTION

RELATIONSHIP TO OTHER APPLICATIONS

This application is a divisional application of U.S. application Ser. No. 13/438,575, filed Apr. 3, 2012, which application is incorporated by reference for all purposes and from which priority is claimed.

BACKGROUND

Residential wooden stairs are usually purchased as a prefabricated unit with the risers (vertical elements) and the treads (horizontal elements) fastened to stringers in their final form. In the prior art, these prefabricated staircases are installed in, for example a home construction, and construction on a home continues with workmen walking up and down the staircase to perform their construction tasks. Even if the treads (the horizontal surfaces) are covered with a protective material, they can suffer damage during the construction process.

After all major construction in the home is completed, workmen must come in and finish the staircase by sanding the treads and risers and applying appropriate finish coatings to them. If the risers and treads are damaged in any way because of months of foot traffic, the refinishing process takes longer and is more expensive.

BRIEF SUMMARY

Embodiments of the invention to be searched avoid the problem by installing a prefabricated staircase where the risers and treads are not the final materials to be used. Rather the tread is a "sub-tread" and the riser is a "sub-riser" meaning that another surface will be applied on top of the sub-tread and sub-riser in order to finish the staircase.

The present invention solves prior art problems by creating a prefabricated staircase that is "double routed" to allow an initial set of sub-treads and sub-risers to be installed. The purpose of the double routing is to provide additional space for a final capping tread and riser to be installed by inserting the capping riser or tread in the routed space. This provides for a simpler installation process where little to no cutting and or fitting of the final treads and risers (referred to herein as "capping treads" and "capping risers") is required.

The double routing is made to a depth that permits a capping tread or riser to be inserted into the routed space and shifted to the right or left in a small amount so that the tread remains in the routed space on either side of the staircase. This allows for a finished look without having to butt the final tread and riser up against the side of the stringer that is secured to the sub-risers and sub-treads. Once the capping riser and/or capping tread is in place, it is secured to the sub-riser or sub-tread (as appropriate) via adhesive or mechanical means (or both) known in the art.

This has several advantages. First, a fully functional staircase is installed so that workmen can proceed with finishing the home or structure without having to worry about whether the finished treads or finished risers are being damaged Second the owner can decide what finish and material to apply to the final tread or riser that is applied over the sub-tread or sub-riser and those capping risers and treads can simply be installed over the sub-tread and sub-riser after all major construction is completed thereby avoid any potential for damage to the capping risers and treads while keeping the stair compliant with appropriate building codes. Other advantages of the various embodiments disclosed herein will be apparent to those of ordinary skill in the art.

DETAILED DESCRIPTION

Figure 1:
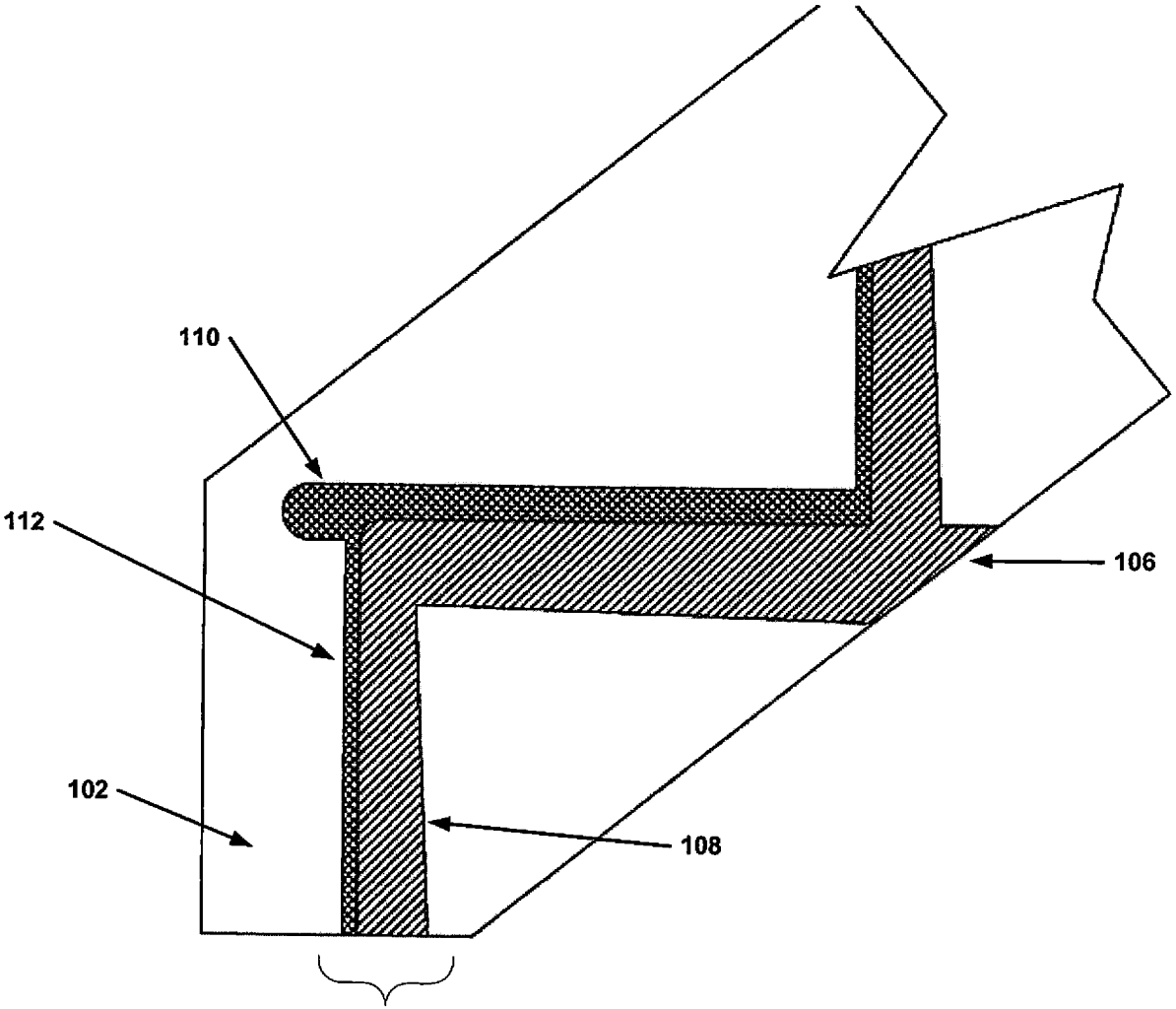
FIG. 1 illustrates a Closed stringer routing used on Boxed and Single Open staircase designs of an embodiment.

Referring now to FIG. 1 a closed stringer routing embodiment is illustrated. The stringer 102 forms the main support for a set of stairs. A stringer is the long piece that the stair treads and risers attach to on either side, and which goes diagonally up the wall. In an embodiment, stringer 102 comprises a double-routed channel shown generally as 104. The double routed space comprises a routed channel wide enough to support a tread and sub-tread (in the horizontal orientation), and a riser and sub-riser (in the vertical orientation) and as further illustrated in FIG. 2 below). The double-routed channel 104 comprises a sub-tread 106 and sub-riser 108 routing areas. Note in this FIG. 1 the illustration is to the routed area. In addition, the double-routed channel 104 further comprises a routing space for a capping tread 110 and a routed space for a capping riser 112. Additionally, the double-routed channel 104 also comprises sufficient room for the insertion of wedge blocks that, in an embodiment, support the sub-tread and sub-riser. These wedge blocks will be discussed below. The double routed spaces are located on the stringer at varying and in some cases uneven locations that eventually provides for the capping treads and risers to be positioned in the staircase such that applicable building codes are met. Double routing as illustrated herein is accomplished using a model CSR-750CNC Stair Router available from US Concepts although this is not meant as a limitation. Other CNC routers may also be appropriate for the double routing illustrated herein.

Figure 2:
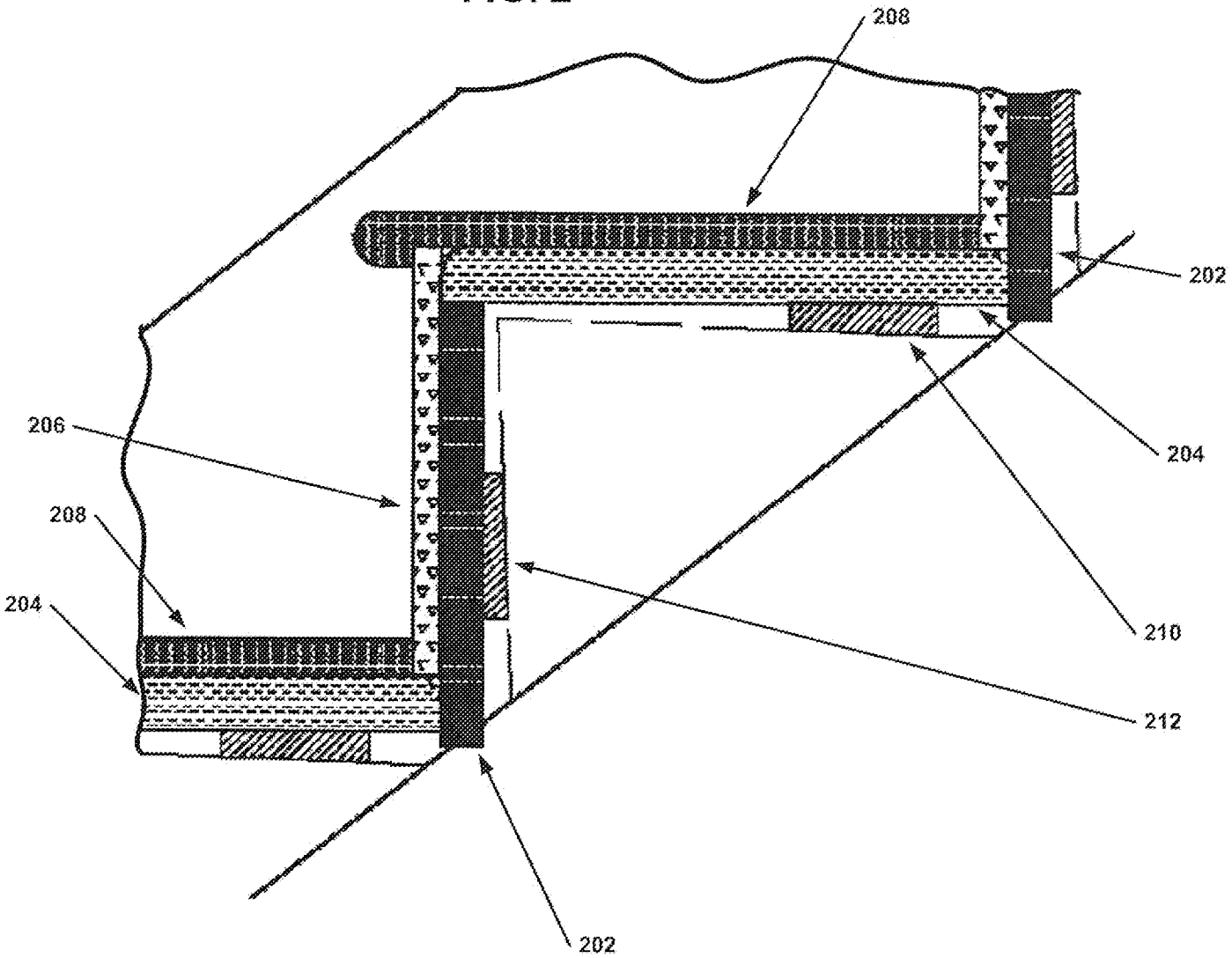
FIG. 2 illustrates a finished installation of treads and risers into a double routed stringer.

FIG. 2 illustrates a finished installation of treads and risers into a double routed stringer. The double-routed channel (FIG. 1, 104) is illustrated together with a sub-riser 202, a sub-tread 204, a capping riser 206, a capping tread 208, sub-tread wedge blocking 210 and a sub-riser wedge blocking 212.

In normal practice of an embodiment, a staircase is constructed using 2 stringers, each of which has double routed channel (FIG. 1, 104) for risers, sub-risers, treads and sub-treads. However, the staircase is initially constructed as a prefabricated staircase or as a staircase kit which can be field assembled into a unit comprising double routed channels and sub-treads and sub-risers. The application of capping treads and risers occurs later as discussed below.

Figure 3:
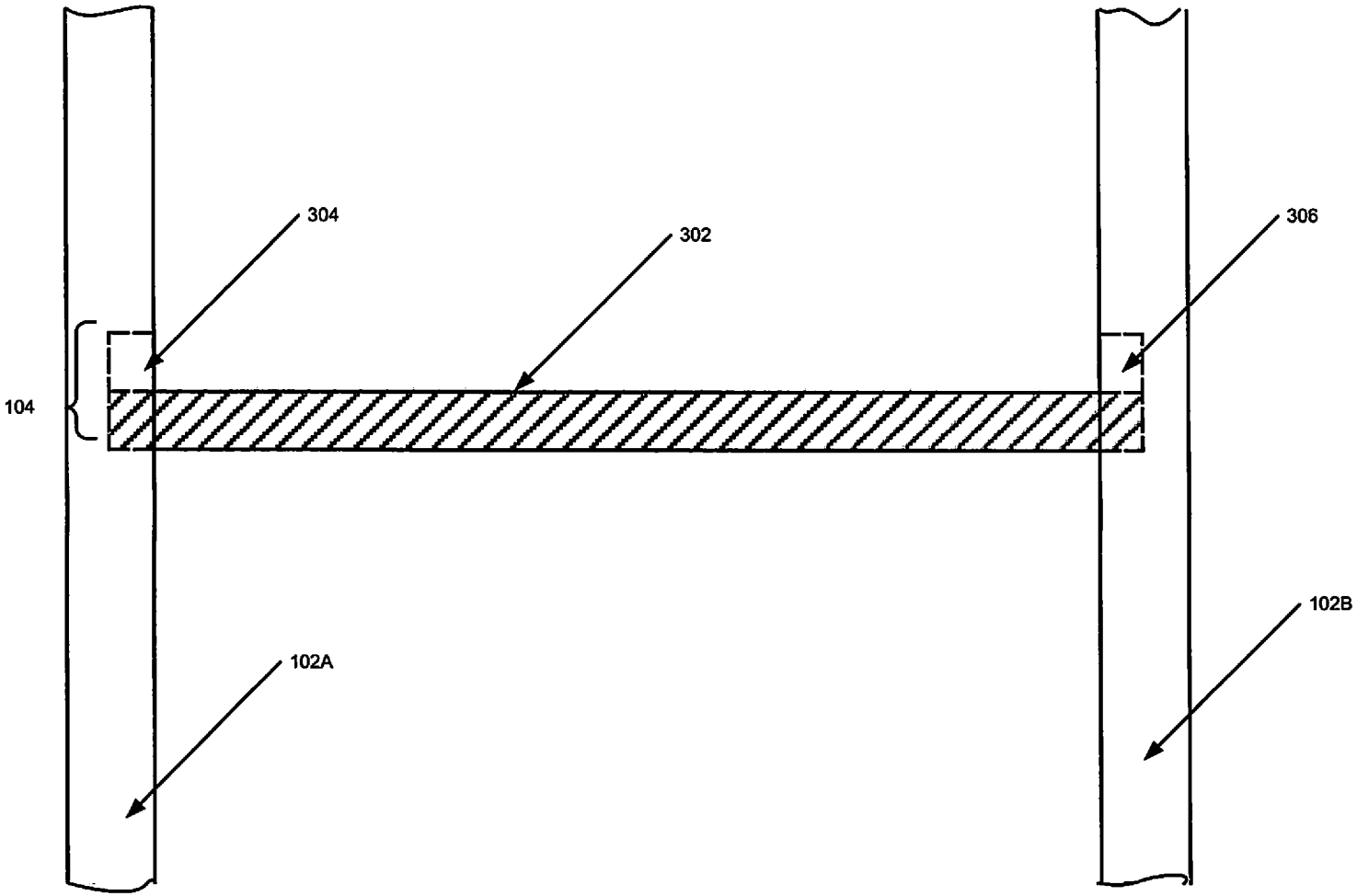
FIG. 3 illustrates a view of an embodiment having a sub-tread installed in stringers.

FIG. 3 illustrates the installation of a sub-tread 302 in stringers 102A and 102B. Double-routed channel 104 allows sub-tread 302 to be recessed and secured into each stringer, 102A and 102B. Because the double-routed channel 104 is double routed, there is sufficient room left for the placement of a capping tread. Channel spaces for capping treads are illustrated as 304 and 306. During construction of the staircase, multiple sub-treads are secured into the stringers 102A, and 102B in as many steps as necessary to span a particular vertical distance. For purposes of this Figure, a single sub-tread is illustrated.

Figure 4:
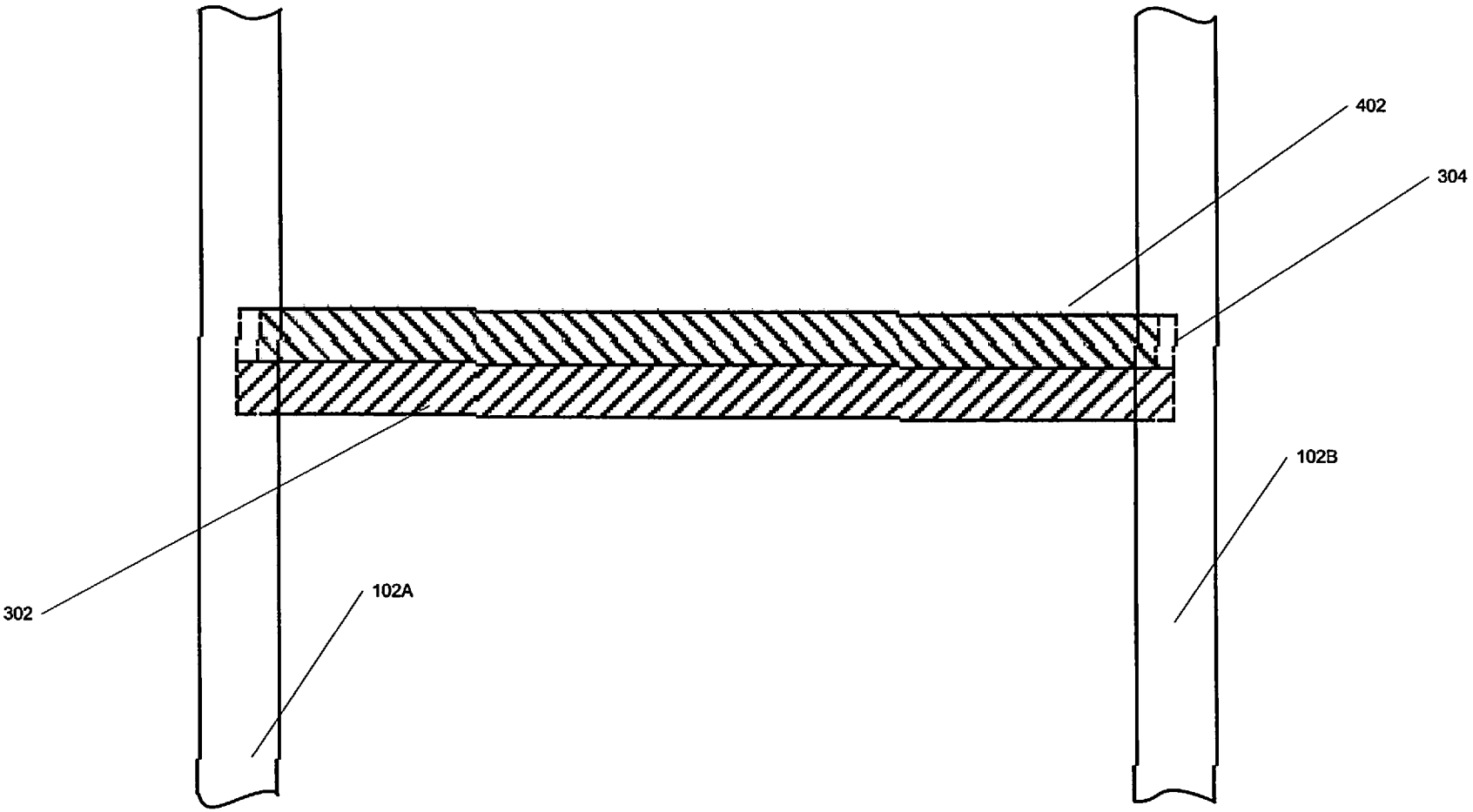
FIG. 4 illustrates a view of an embodiment having sub-tread and capping tread installed in stringers.

FIG. 4 illustrates the installation of the capping tread. Once the sub-treads 302 and stringers 102A and 102B are assembled, the installation of a capping tread can occur. The capping tread 402 is cut to a length that is less than the full length of sub-tread 302. This allows the capping tread 402 to be inserted into the remaining open section of the double-routed channel 304. Because the capping tread is shorter than the full length of sub-tread 302 it can be inserted fully into the double-routed channel for capping-tread 304 to house the capping tread lowered into place and then shifted laterally so that the capping tread is surrounded by and contained in the double routed capping tread channel yet still is embedded in stringers 102A and 102B. The capping tread 402 can then be secured to sub-tread 302 with adhesives or fasteners known in the art.

Figure 5:
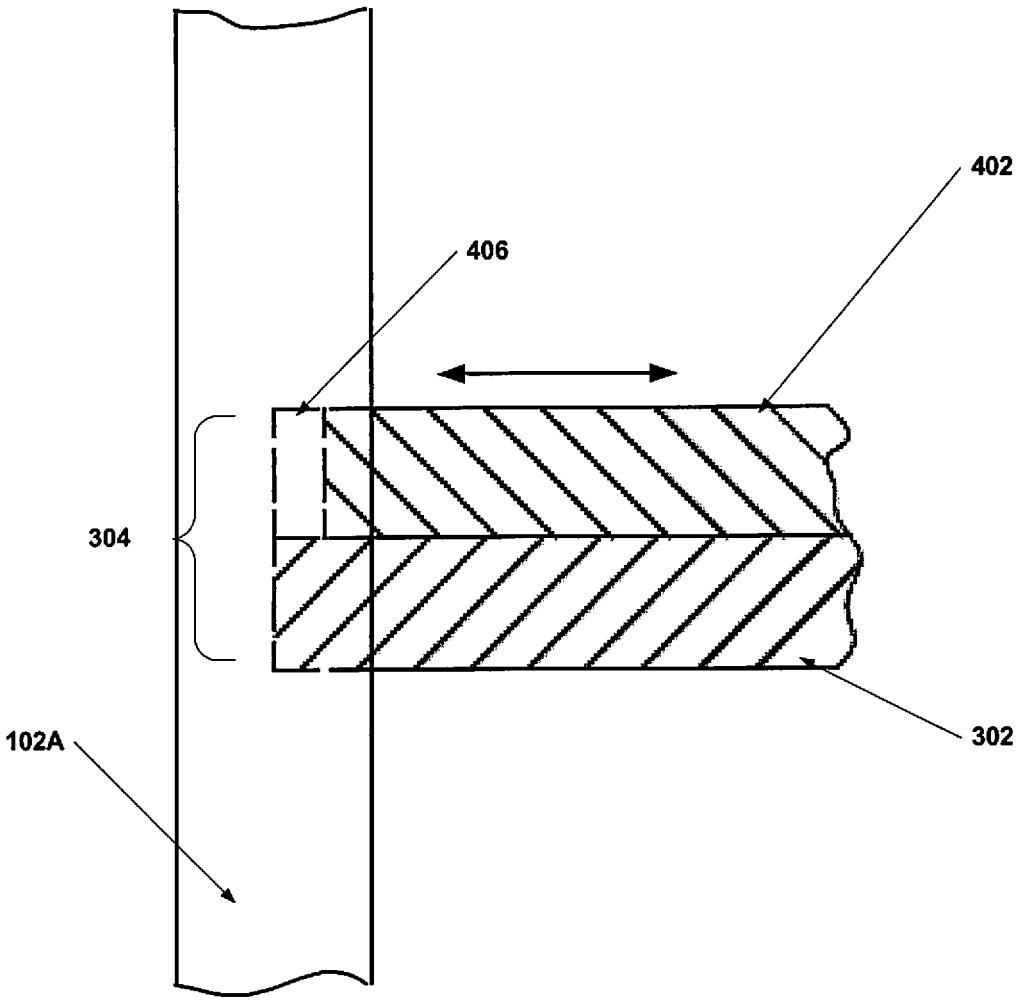
FIG. 5 illustrates an enlarged view of the finished installation of sub-tread and sub-riser.

FIG. 5 illustrates an enlarged detail of the final installation of the capping tread 402 and sub-tread 302. In this illustration stringer 102A is shown with the double-routed channel 304 (illustrated in phantom) with sub-tread 302 installed into stringer 102A. Capping tread 402 is shown in its final position where it has been initially inserted into double-routed channel 304 and moved laterally to fit partially into double-routed channel 304 of stringer 102A and double-routed channel 306 of stringer 102B (not shown). While this leaves a slight unfilled portion 406 of double routed channel 304, the capping tread 402 is still completely embedded in and surrounded by stringer 102A and similarly in stringer 102B.

Figure 6:
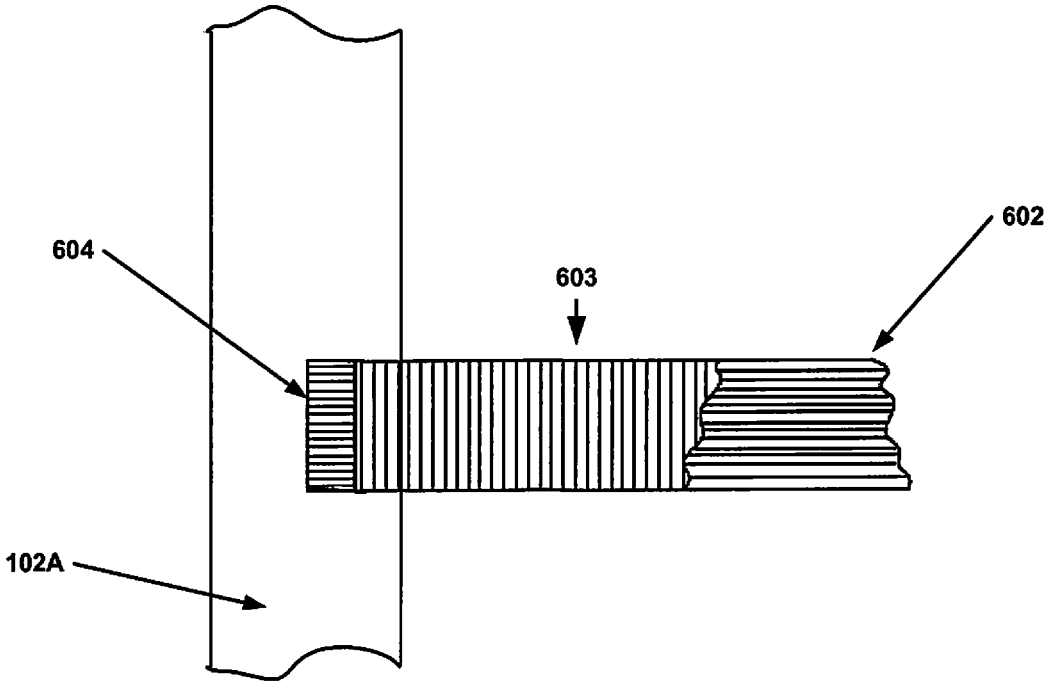
FIG. 6 illustrates the final installation of a sub-riser and the capping riser.

FIG. 6 illustrates the final installation of a sub-riser and the capping riser. In this Figure, sub-riser 602 is installed in stringer 102A in the same manner described above with respect to the sub-treads. Once the staircase is fully fabricated with sub-risers and sub-treads, capping risers and capping treads can be installed. As illustrated in FIG. 6 sub-riser 602 is installed in double routed riser channel 604. Sub riser 602 is illustrated in horizontal hatching. Capping riser 603 can then be inserted into double routed riser channel 604 and then moved laterally to engage a similar channel in stringer 102A. Thus, while capping riser 603 does not fully occupy double-routed riser channel 604 it is still surrounded by stringer 102A and similarly on the opposite side is surrounded by stringer 102B (not shown).

Figure 7:
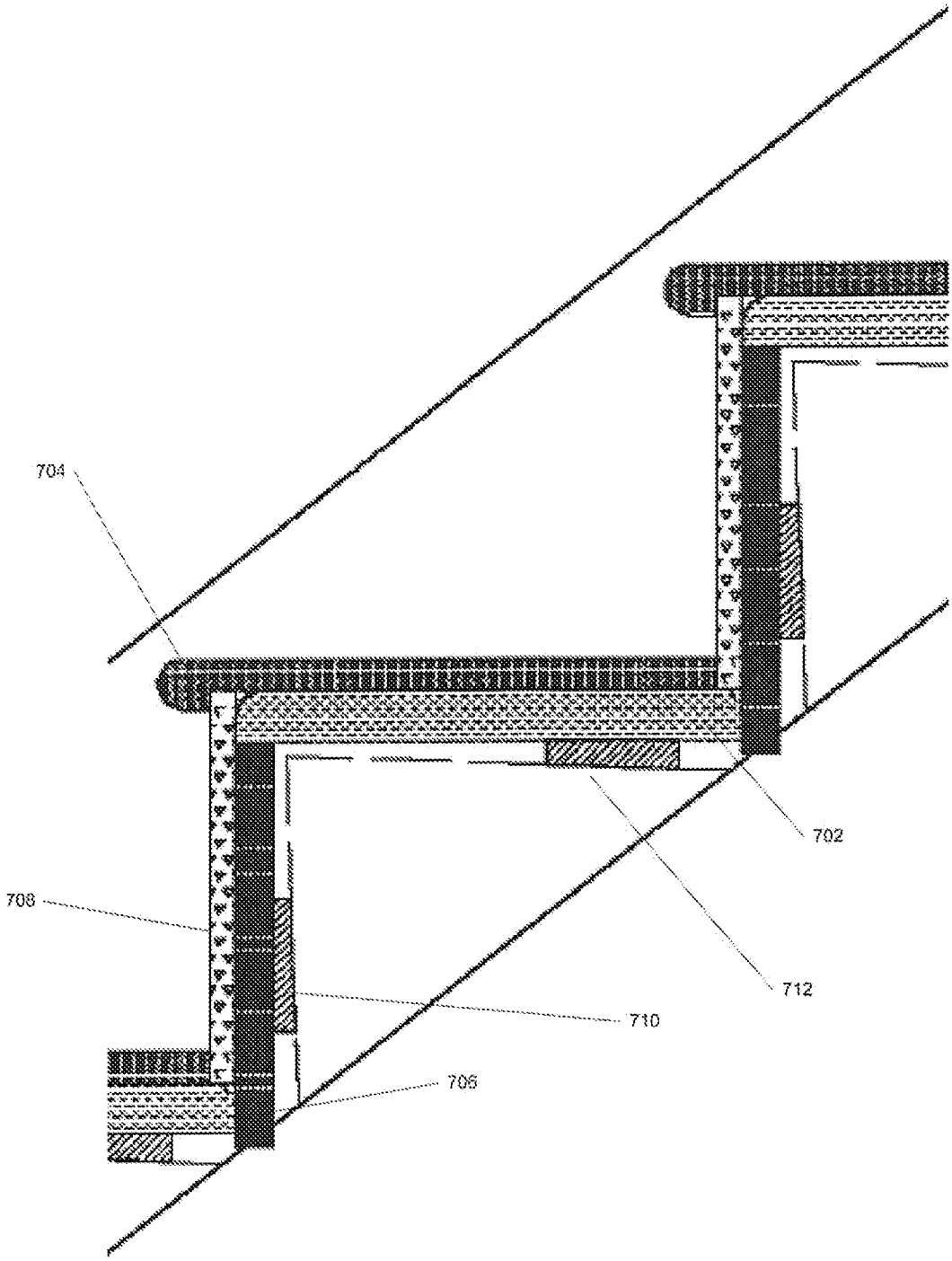
FIG. 7 illustrates a side view of an embodiment of an assembled staircase.

FIG. 7 illustrates a side view of the assembled staircase of an embodiment. In this embodiment, sub-tread 702 is in place in the double routed tread channel. A capping tread 704 is installed in the double routed tread channel over the top of sub-tread 702 and the combination of sub-tread 702 and capping tread 704 is held in place by tread wedge blocking 712. Similarly, sub-riser 706 is in place in the double routed channel with capping risers 708 installed on top of sub-riser 706. The combination of sub-riser 706 and capping riser 708 are held in place by sub-riser wedge block 710.

Figure 8:
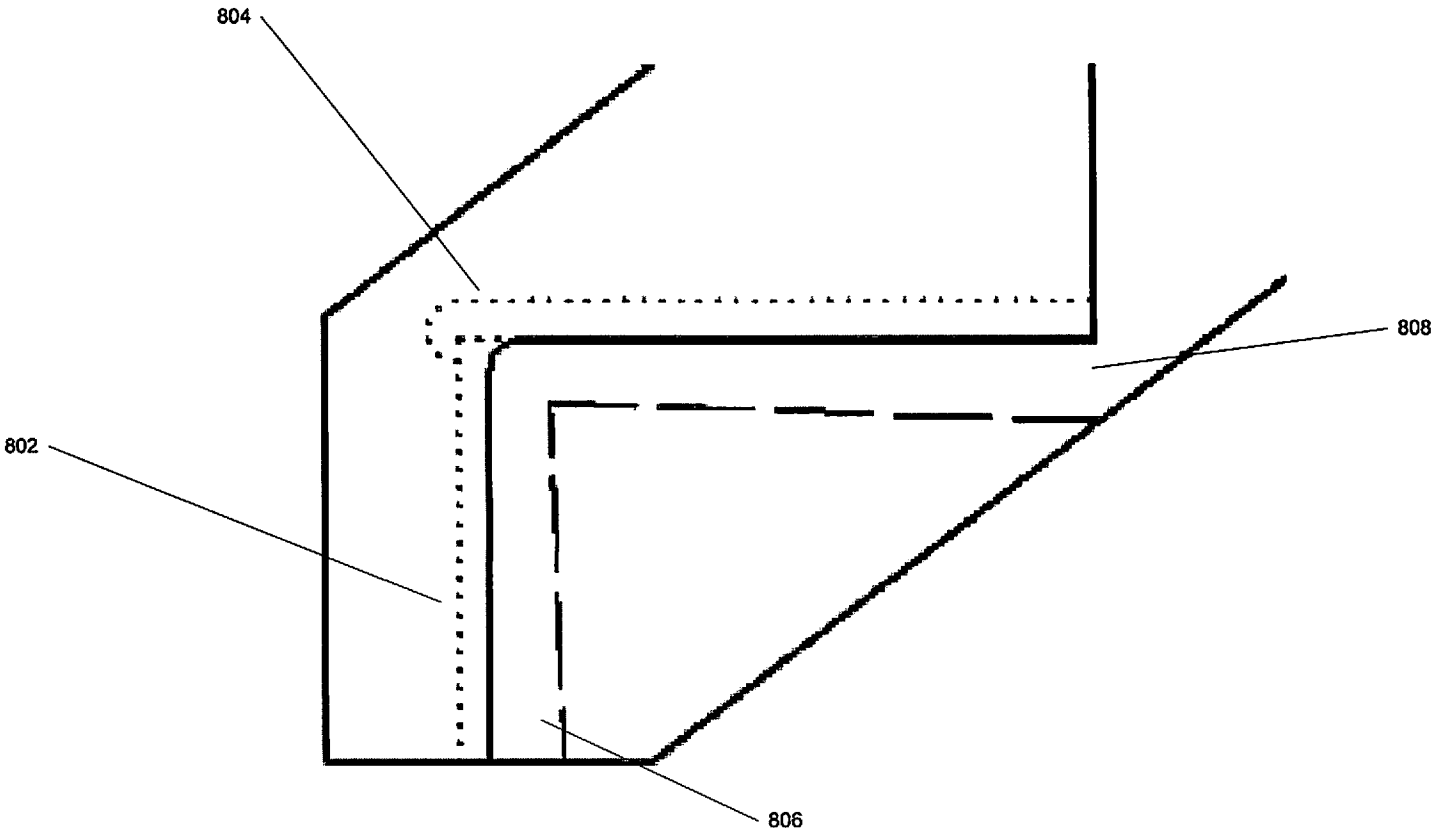
FIG. 8 illustrates an embodiment of the routing for sub-risers and sub-treads.

FIG. 8 illustrates the routing for sub-risers and sub-treads. Routing channel for sub-riser 806 is illustrated together with the routing channel for capping riser routing channel 802. Similarly the sub-tread routing 808 is illustrated together with the capping tread routing channel 804. It should be noted that while capping tread routing channel 804 is shown with a "bullnose" design, this is merely a design choice. The capping tread routing channel 804 may have other edge designs that equally fall within the scope of the various embodiments illustrated herein.

In an embodiment, the first riser of a staircase of the various embodiments illustrated herein will be shorter than other risers in the staircase by an amount equal to the thickness of the first capping tread. That thickness of the capping tread will add to the height of the first step. In order to have all steps of a similar height, it is therefore necessary to have the first riser of the staircase be shorter by the same amount as the thickness of the first capping tread. Thereafter, all riser heights will be the same for subsequent steps in the staircase.

Figure 9:
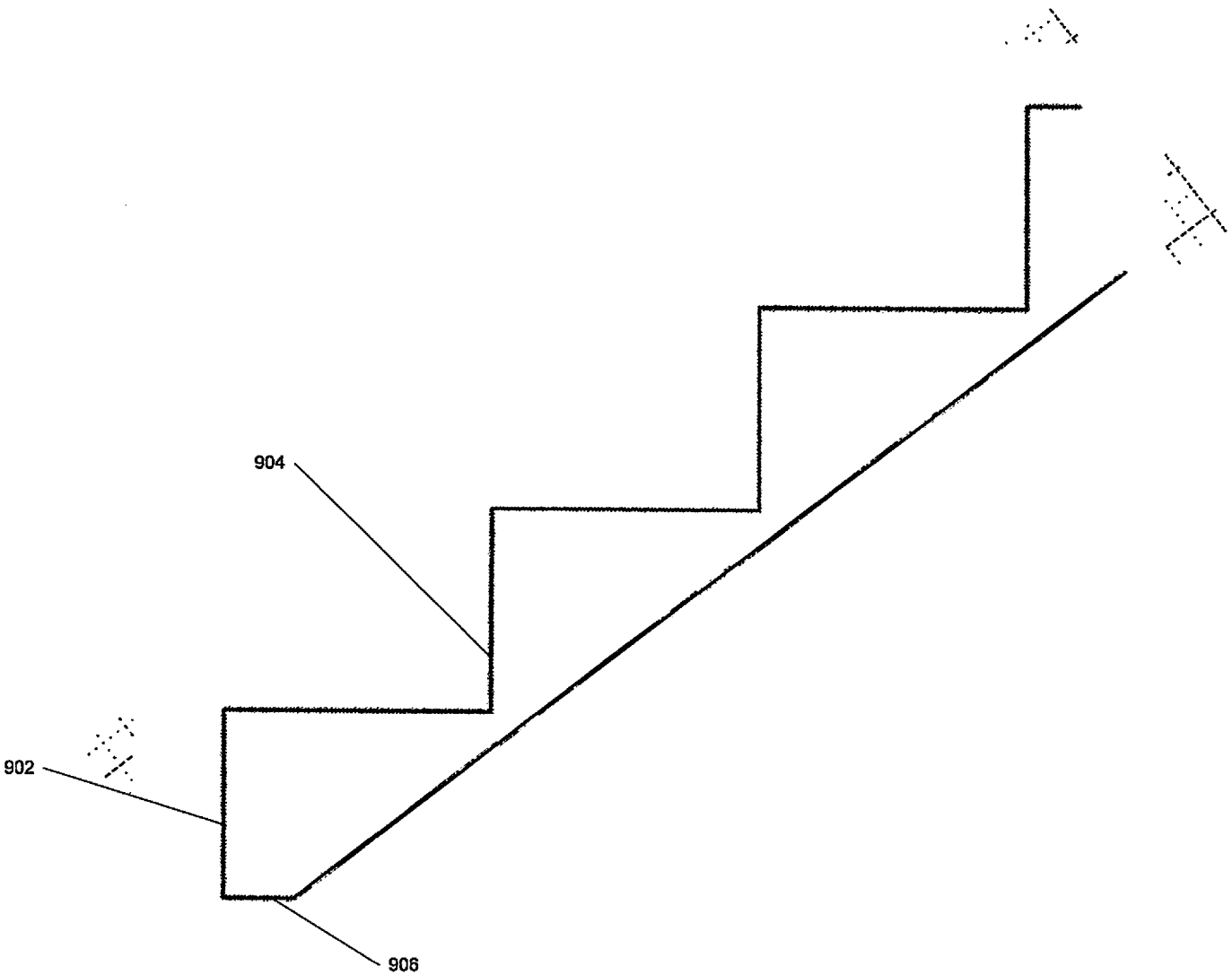
FIG. 9 illustrates an embodiment of the open riser and tread layout.

It should be noted that multiple configurations of staircases falling within the various embodiments illustrated herein are possible. For example, and referring to FIG. 9 an open riser and tread layout is illustrated. In this case the floor level stair stringer is set on floor level 906. However the first sub-riser height 902 will be will be shorter by the same amount as the thickness of the capping tread. Thus for example, and without limitation, in a sample staircase the first riser height would be 7⅜ inches. All successive sub-riser heights 904 will be 8 inches in height. When the first riser 902 has a ⅝ inch thick oak tread installed at the top of the riser, this will make that riser height 8 inches. Thus each step will have the same height. In this fashion the "first staircase step" height will be the combination of the first riser height plus the thickness of the first sub-tread, plus the thickness of the first capping tread.

Figure 10:
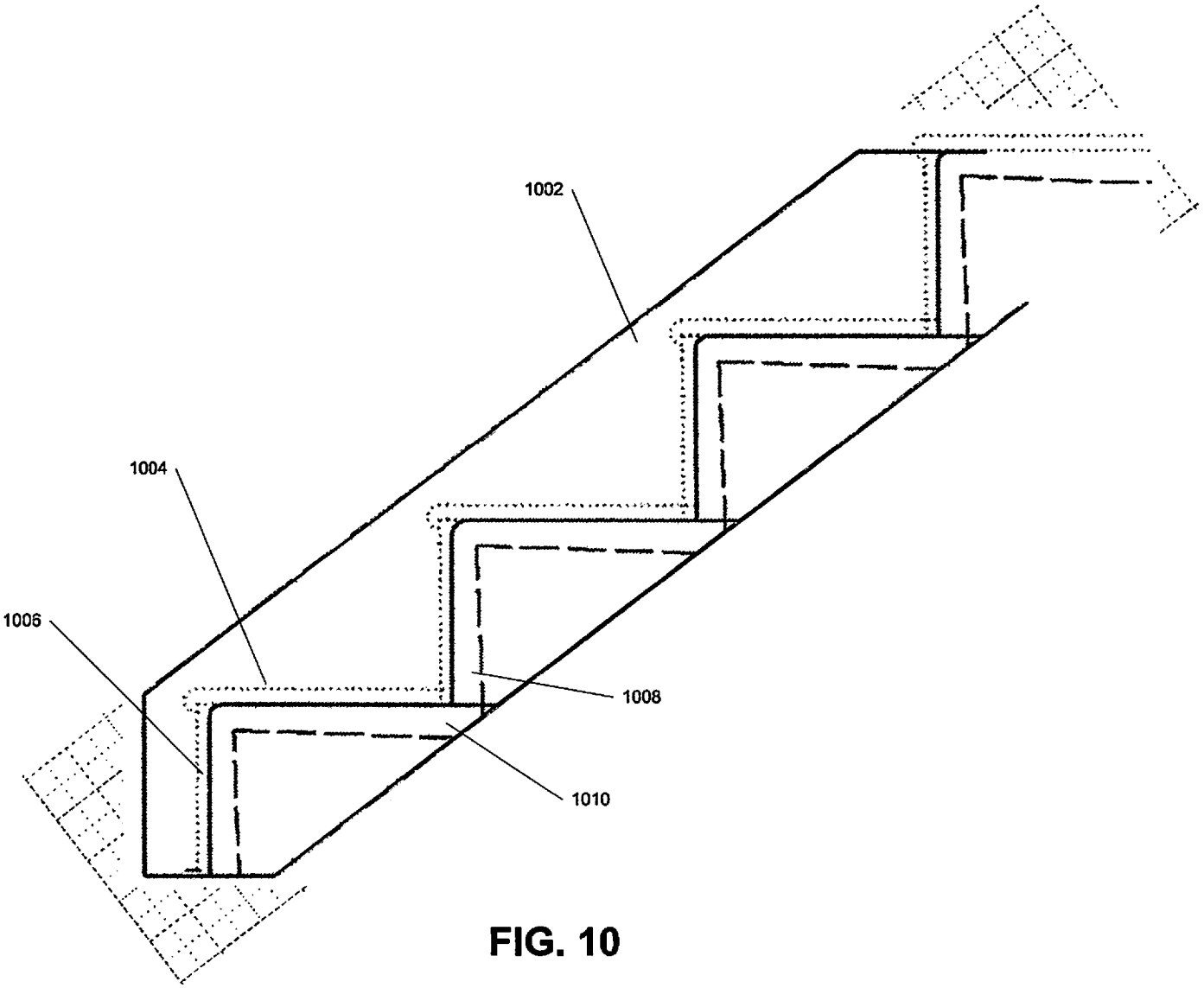
FIG. 10 illustrates an embodiment of a staircase having the double routed channels of differing depths.

Referring now to FIG. 10, a staircase is illustrated having the double routing channels of differing depths. In this embodiment, stringer 1002 comprises double routed channels for sub-treads, sub-risers capping treads and capping risers. It should be noted that it is not a requirement that the depth of the routed channels be the same. For example sub-riser channel 1008 may, in an embodiment, be ½ inch deep. Similarly the sub-tread channel 1010 may also be ½ inch deep. However in this embodiment, the capping riser channel 1006 may only be ¼ inch deep. Similarly the capping tread channel 1004 may also be only ¼ inch deep. Other combinations of channel depths are also considered to be within the scope of the various embodiments disclosed herein.

A method for creating and building a staircase has been described. It will be understood by those skilled in the art that the present invention may be embodied in other specific forms without departing from the scope of the invention disclosed and that the examples and embodiments described herein are in all respects illustrative and not restrictive. Those skilled in the art of the embodiments illustrated herein will recognize that other embodiments using the concepts described herein are also possible. Further, any reference to claim elements in the singular, for example, using the articles "a," "an," or "the" is not to be construed as limiting the element to the singular.

What is claimed is:

1. A method for constructing a staircase, comprising:

routing a plurality of corresponding riser channels in each of a first staircase stringer and a second staircase stringer, wherein each of the plurality of corresponding riser channels comprises:

a sub-riser channel routed at a first depth and having a width sufficient to encompass a thickness of a sub-riser, and a capping riser channel routed at a second depth less than the first depth and having a width sufficient to encompass a thickness of a capping riser;

routing a plurality of corresponding tread channels in each of the first staircase stringer and the second staircase stringer, wherein each of the plurality of corresponding tread channels comprises:

a sub-tread channel routed at a third depth and having width sufficient to encompass a thickness of a sub-tread, and a capping tread channel routed at a fourth depth less than the third depth and having a width sufficient to encompass a thickness of a capping tread;

assembling the first and second staircase stringers together with a plurality of sub-treads in corresponding sub-tread channels of the plurality of corresponding tread channels and a plurality of sub-risers in corresponding sub-riser channels of the plurality of corresponding riser channels;

installing capping risers in corresponding capping riser channels of the plurality of corresponding riser channels; and installing capping treads in corresponding capping tread channels of the plurality of corresponding tread channels.

2. The method for constructing a staircase of claim 1, wherein each of the capping risers and capping treads is of a length shorter than a length of a corresponding sub-riser and sub-tread, but equal to or greater than a dimension between non-routed portions of the first and second stringers of an assembled staircase.

3. The method for constructing a staircase of claim 2, wherein installing the capping risers and capping treads comprises inserting a first end of each capping riser into a corresponding capping riser channel of the first staircase stringer and inserting a first end of each capping tread into a corresponding capping tread channel of the first staircase stringer and sliding each capping riser and capping tread laterally so that each capping riser and each capping tread is partially embedded into the corresponding capping riser channels and the corresponding capping tread channels of the first and second stringers.

4. The method of claim 1, further comprising routing a first sub-riser channel so that a height of a first sub-tread is less than a finished stair height by an amount equal to a thickness of a capping tread to be applied to a first sub-tread of the staircase.

5. The method of claim 1 further comprising routing a first sub-riser channel so that a height of a first sub-tread in the staircase is less than a capping tread height by an amount equal to a thickness of the capping tread and wherein a second sub-riser height is taller than a first sub-riser by an amount equal to a thickness of a first staircase step capping tread minus a thickness of a second staircase step capping tread, and wherein subsequent sub-riser heights are equal to a set staircase rise.

6. The method of claim 1, wherein the staircase comprises a box staircase.

7. The method of claim 1, wherein the staircase comprises a one-side-open stair tread.

8. The method of claim 1, wherein the staircase comprises a two-side-open stair tread.

9. The method of claim 1, wherein the staircase comprises a staircase from the group consisting of a curved box staircase, a curved one-side-open staircase, and a curved two-side-open staircase.

10. The method of claim 1, wherein the first step in the staircase is constructed from the group consisting of a one-side-open bullnose step, and a two-side-open bullnose step.

11. The method of claim 1, wherein the first staircase step comprises a double bullnose capping tread and the first step stringers are constructed as two-side-open stringers allowing the double bullnose capping tread to be installed.

12. The method of claim 1, wherein the first staircase step comprises a single bullnose capping tread and the first step stringers are notched and one-side-open allowing the double bullnose capping tread to be installed.

13. The method of claim 1, further comprising:

notching the first staircase stringer when a staircase transitions from one-side open or two-side open to a box/closed stringer allowing for installation of the capping tread when transitioning from a boxed/closed first and second staircase stringers to a one-side-open or two-side open staircase.

14. The method of claim 1, wherein the capping tread comprises a capping bullnose tread.

15. The method of claim 1, wherein the portion of the tread channel routed at the third depth is tapered and dimensioned for use with a tread wedge block.

16. The method of claim 1, wherein the portion of the riser channel routed at the first depth is tapered and dimensioned for use with a riser wedge block.

* * * * *